US006901907B2

(12) United States Patent
Wijaya

(10) Patent No.: US 6,901,907 B2
(45) Date of Patent: Jun. 7, 2005

(54) AIR-STIRRING BLADE FOR AN INTERNAL COMBUSTION ENGINE

(76) Inventor: Heru Prasanta Wijaya, Graha Famili D. 183. Pr. Kali Kendal, Surabaya 60226 (ID)

( * ) Notice: Subject to any disclaimer, the term of this patent is extended or adjusted under 35 U.S.C. 154(b) by 0 days.

(21) Appl. No.: 10/789,356

(22) Filed: Feb. 26, 2004

(65) Prior Publication Data

US 2004/0206330 A1 Oct. 21, 2004

Related U.S. Application Data

(63) Continuation of application No. PCT/IB01/01198, filed on Jun. 29, 2001.

(51) Int. Cl.[7] ..... F02M 29/00; B01F 3/02
(52) U.S. Cl. ..... 123/306; 123/592; 48/189.4
(58) Field of Search ..... 123/306, 590, 123/592; 48/189.4

(56) References Cited

U.S. PATENT DOCUMENTS

| | | | | |
|---|---|---|---|---|
| 2,740,392 A | * | 4/1956 | Hollingsworth | 123/592 |
| 3,395,899 A | | 8/1968 | Kopa | |
| 3,437,467 A | * | 4/1969 | Jacobus | 123/590 |
| 4,151,816 A | | 5/1979 | SchrOder | |
| 4,672,940 A | * | 6/1987 | Nakayama et al. | 48/189.4 |
| 5,113,838 A | * | 5/1992 | Kim | 123/592 |
| 6,536,420 B1 | * | 3/2003 | Cheng | 123/590 |
| 6,796,296 B2 | * | 9/2004 | Kim | 123/590 |
| 2001/0001388 A1 | | 5/2001 | Buswell et al. | |
| 2003/0150439 A1 | * | 8/2003 | Hsu | 123/592 |
| 2004/0031471 A1 | * | 2/2004 | Leuenberger | 123/590 |

FOREIGN PATENT DOCUMENTS

| | | |
|---|---|---|
| BE | 347113 | 1/1928 |
| DE | 30 02 325 A1 | 7/1981 |
| WO | WO 94/02735 | 2/1994 |
| WO | WO 00/06889 | 2/2000 |

OTHER PUBLICATIONS

International Search Report of PCT/IB01/01198, dated Mar. 11, 2002.
International Preliminary Examination Report of PCT/IB01/01198, dated Oct. 10, 2003.

* cited by examiner

*Primary Examiner*—Erick Solis
(74) *Attorney, Agent, or Firm*—Christie, Parker and Hale, LLP

(57) ABSTRACT

The air-stirring blade is provided that comprises a cylindrical body whose mid portion is provided with blade of such a construction that the inner side of the blade takes the form of stirred grooves with dip angle of about 10° to 80° or typically 30° with respect to vertical axis of the body. The outer side of the blade is of the same shape with the inner side thereof and there are four tangent lines between the blade and body forming a channel of cap-shaped cross-section which is twisted along the body.

11 Claims, 5 Drawing Sheets

*Test results showing the relation between fuel consumed (in secs) and power produced (in hp) by an internal combustion engine using three different types of air-twisting device*

| No | Machine rpm | Standard | | PCT/IB99/0029 | | New Invention | |
|---|---|---|---|---|---|---|---|
| | | Power (hp) | Fuel (Sec) | Power (hp) | Fuel (Sec) | Power (hp) | Fuel (Sec) |
| 1 | 1.000 | 2 | 48.16 | 3 | 51.05 | 4 | 68.20 |
| 2 | 1.500 | 15 | 24.78 | 15 | 46.58 | 17 | 37.16 |
| 3 | 2.000 | 25 | 13.99 | 26 | 19.91 | 26 | 31.60 |
| 4 | 2.500 | 35 | 8.63 | 38 | 15.35 | 41 | 18.73 |
| 5 | 3.000 | 49 | 6.66 | 50 | 10.68 | 56 | 14.54 |
| 6 | 3.500 | 67 | 5.55 | 66 | 8.57 | 73 | 7.41 |
| 7 | 4.000 | 81 | 4.90 | 82 | 6.01 | 91 | 4.96 |
| 8 | 4.500 | 101 | 3.37 | 102 | 3.39 | 99 | 3.34 |

*Fuel in secs refers to the time needed to use up a 25 ml bulb*
*Power Produced is power transmitted by wheel to dynamometer*

Fig · 6

*Graphs showing the relation between normal fuel consumption and power*

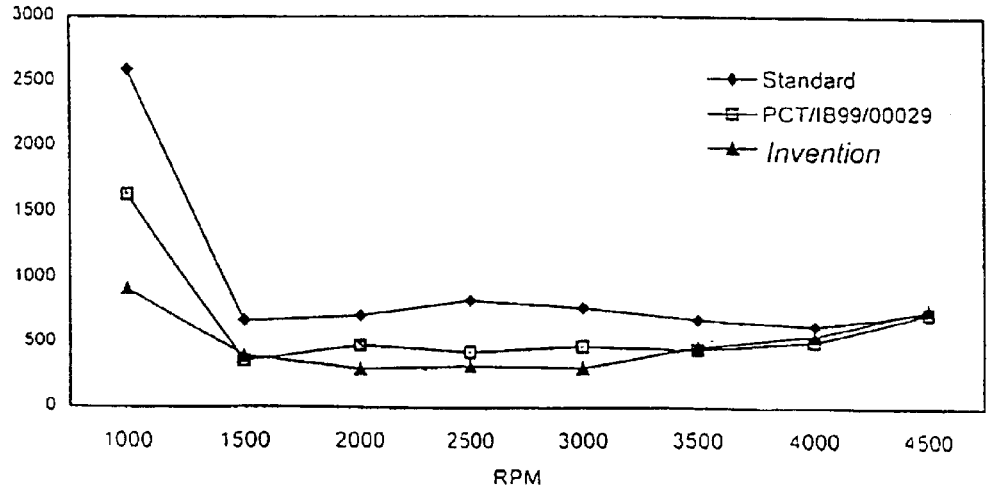

Fig · 7

AIR-STIRRING BLADE FOR AN INTERNAL COMBUSTION ENGINE

CROSS-REFERENCE TO RELATED APPLICATION

This application is a continuation application of International Application Number PCT/IB01/01198, filed Jun. 29, 2001.

TECHNICAL FIELD OF INVENTION

This invention relates to an inlet for air from the atmosphere into an internal combustion engine attached particularly before the engine air filter and after the combustion engine.

BACKGROUND OF INVENTION

In order to be leading in current technology, an internal combustion engine mounted in automotive vehicles should reveal a good performance. To have a good performance, an internal combustion engine should have a sufficient acceleration and an optimal use of fuel. These requirements can be met by improving quality of the combustion process of air-fuel mixture within the engine.

Another way of improving the quality of combustion process of air-fuel mixture within an automotive engine is to improve the quality of air-fuel mixture. A qualified combustion process of air-fuel mixture requires that an agitating effect should occur within the mixture. An agitating effect is a phenomenon triggered and left by a stirring effect in air before the air is mixed with the fuel.

The stirring effect is recently produced by providing auxiliaries such as grooves in the air inlet. The grooves are of many types and each has its own advantage and drawback.

The prior art related to this present invention is Air-Stirring Device for Automotive Vehicles (PCT/IB99/00029).

This invention thus improves the quality of air-fuel mixture by generating a twisting effect, maintain it as long as possible and increase the turbulency of the air-fuel mixture leaving the outlet-side of the air-stirring blade.

SUMMARY OF THE INVENTION

As disclosed above, the subject of this invention is a device which enables the atmosphere to flow turbulently into the engine of automotive vehicles. Compared with the prior art cited above, i.e., PCT/1B99/00029, one of the advantages possessed by embodiments of the present invention is an increasing turbulency of the air-fuel mixture leaving the outlet part of this air-stirring blade due to lesser air-resistance or loss of head.

The location of this air stirring blade with carburetor within an automotive engine is shown schematically in FIG. 1. Air-stirring blade (F) is mounted after or on air channel (B) and before carburetor (C). FIG. 2 shows schematically the air-stirring blade if mounted within an internal combustion engine on channel (B) after air filter (A) and before engine combustion chamber (E) by means of an injection system.

The preferred embodiment of this invention (shown in FIG. 3) comprises a cylindrical body (1) whose mid portion is provided with blade (2) constructed in such a way that the inner side of the blade (2*a*) takes the form of stirred grooves with dip angle (3) of about 10° to 80° or typically 30°. The shape of the outer side of the blade (2*b*) is the same with that of the inner side (2*a*) of the blade. There are four tangent lines between blade (2) and body (1). The four tangent lines form a channel with cap-shaped cross-section (5) which is twisted along body (1).

FIG. 3 is a preferred embodiment of this invention whilst FIGS. 4 and 5 are its modifications. It can be seen from FIGS. 3, 4 and S that the air flowing from this air-stirring blade is in stirred condition enabling the occurrence of an agitating effect within the air-fuel mixture.

BRIEF DESCRIPTION OF THE DRAWINGS

FIG. 6 is a table showing performance of an internal combustion engine of standard type equipped successively with an air twisting device disclosed in PCT/1B99/00029 and an embodiment of the air-stirring device of the present invention; and FIG. 7 is a experimentally-derived graph showing the relation between fuel consumed and power yielded by an internal combustion engine of standard type, equipped with air twisting-device disclosed in PCT/IB99/00029, and equipped with one embodiment of the air-stirring device of the present invention.

DETAILED DESCRIPTION OF THE PREFERRED EMBODIMENTS

This invention improves the performance of an automotive engine without any significant changes in the previous design of the engine. A satisfied result in the form of a well stirred air flowing into the automotive engine can be performed by optionally attaching an air-stirring device on the engine.

Air-stirring device that can be attached without necessarily changing the engine construction has been disclosed in PCT/1B99/00029.

The turbulency of the air-fuel mixture leaving the outlet part of the air-stirring device disclosed in PCT/IB99/00029 is considerably lower than that of embodiments according to this invention.

Based on that fact, embodiments of this present invention ensures as well as increases the turbulency of the air-fuel mixture leaving the outlet part of the device disclosed in PCT/1B99/00029 by means of a twisted air channel (5) attached on the solid portion of the air-stirring device disclosed in PCT/IB99/00029.

Figure 1:
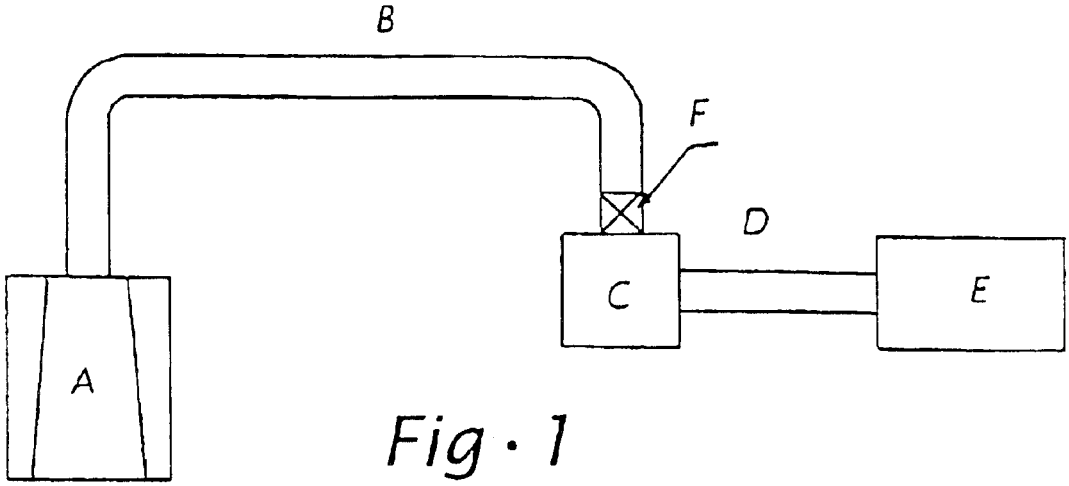
FIG. 1 shows schematically the mounting of an air-stirring stirring blade within an internal combustion engine with carburetor where A, B, C, D, E are successively air filter, air channel, carburetor, intake manifold, engine combustion chanter, and air-stirring device.
Figure 2:
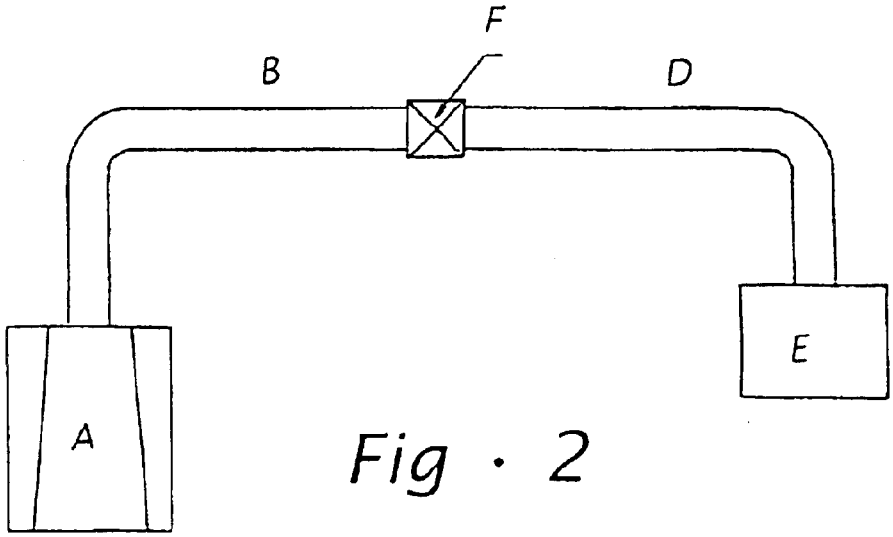
FIG. 2 shows schematically the mounting of air-stirring device within an internal combustion engine using an injection system, where A, B, D, E and F are successively air filter, air channel, intake manifold, engine combustion chamber, and air-stirring device.

The attachment of an embodiment of the air-stirring device presently invented on an internal combustion engine is shown in FIG. 1. This air-stirring device (F) is attached after the air channel (B) or on the air channel (B) but before the carburetor (C). Such position of attachment is intended to provide an airflow which has been twisted before entering the carburetor (C). Since the air has been twisted before entering the carburetor (C), the air-fuel mixture entering the engine combustion chamber (E) will have been twisted as well as agitated. To achieve an optimal agitating effect, this air-stirring device (F) is attached in an internal combustion engines not in one place only, but in other places as well, such as on the air channel (B) or in the front of an intake manifold (D).

The preferred embodiment of this invention (shown in FIG. 3) comprises a cylindrical body (1) provided with blade (2) which is shaped in such a way that the inner side of the blade (2*a*) takes the form of stirred grooves with dip angle (3) of about 10° to 80° or typically 30° with respect to vertical axis of the body. The outer side of the blade (2*b*) is of the same shape with the inner side (2*a*) thereof. The four tangent lines between blade (2) and body (1) form a channel of cap-shaped cross-section (5) which is twisted along the body (1). The number of tangent lines (4) between the body (1) and the blade (2) is dictated by the number of grooves formed on the blade (2). The number of tangent lines is not always four as cited above, and may vary in different embodiments. The minimum number of grooves is usually two but more grooves are allowed when needed.

Tests are conducted by comparing measured parameters of an internal combustion engine mounted on powered vehicles using an injection system on standard condition (without an air-stirring device), using an air-stirring device disclosed in PCT/1B99/00029, and using an embodiment of the air-stirring blade presently invented. The parameters were measured for each condition under specified rpms of the internal combustion engine. Parameters observed in the test are the time needed to use up 25 ml of fuel, the engine rpm at that time and the related power of the engine. Power is measured by dynamometer.

The data obtained are tabulated in FIG. 6. The fuel consumed per second calculated from data shown in FIG. 6 is then interrelated to the power of the engine. The graph produced is shown in FIG. 7.

FIG. 7 shows that to produce the same power at all rpms, the internal combustion engine equipped with the air-stirring blade presently invented consumes less fuel than the same engine equipped with an air-stirring device disclosed in PCT/1B99/00029 and the internal combustion engine equipped with nothing. With respect to PCT/1B99/00029, at rpms below 3500, the internal combustion engine equipped with an embodiment of the air-stirring blade presently invented consumes less fuel to produce power at the same rate. However at an rpm of 1500, the internal combustion engine equipped with the embodiment of the air-stirring blade presently invented and the internal combustion engine equipped with the device disclosed in PCT/1B99/00029 consume fuel of the same amount.

Figure 3:
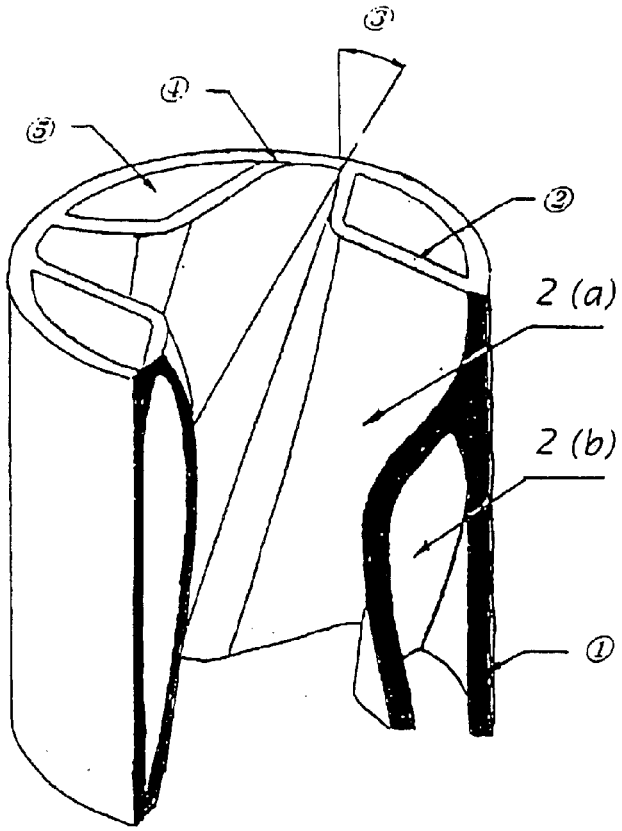
FIG. 3 is a perspective cut-out view of a preferred embodiment of this invention where (1), (2), (3), (4) and (5) are successively body, blade, dip of twisting, tangent lines, and twisted channel.
Figure 4:
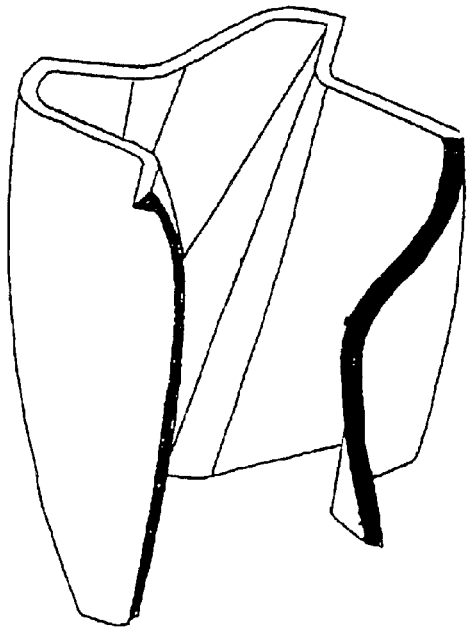
FIG. 4 is a perspective cut-out view of a modification of the embodiment shown in FIG. 3 in the form blade only, without body.

FIG. 3 is a preferred embodiment of this invention whilst FIG. 4 and S show modifications thereof. The modification in FIG. 4 is in the form of blade (2) only following the omission of the cylindrical parts of its body (1). Modification in FIG. 4 can be made if the air-stirring blade acts as an inserting part, and body (1) of the air-stirring blade is of such construction to be integrated with the air channel within the internal combustion engine.

Figure 5A:
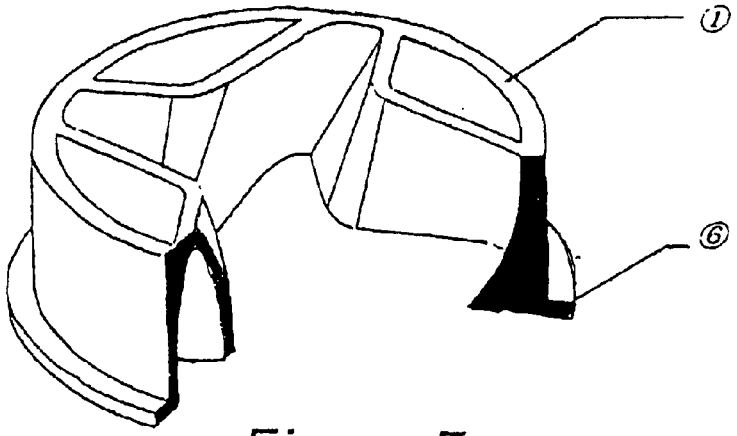
FIG. 5*a* is a perspective cut-out view of yet another embodiment, showing an air-stirring device which is provided with lips on its body.

FIG. 5*a* shows another modification of this embodiment of the invention where the body (1) is equipped with an additional lip (6).

Figure 5B:
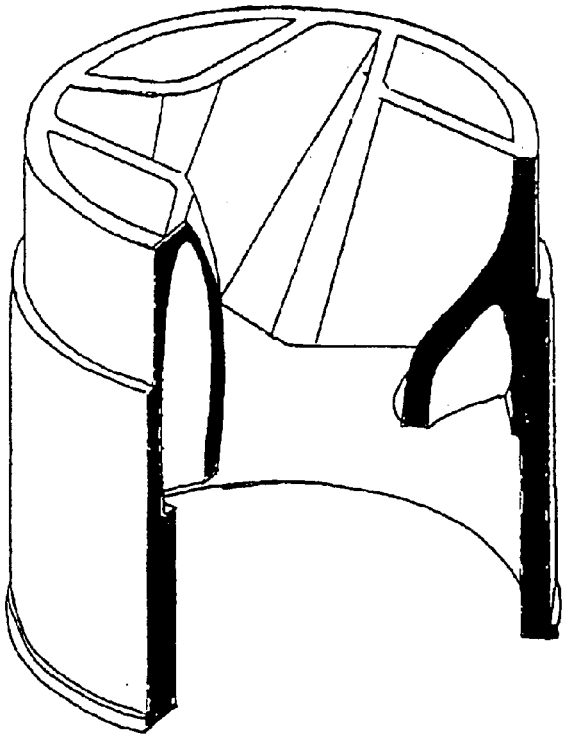
FIG. 5*b* is a perspective cut-out view of yet another embodiment, showing an air stirring device acting as a joint for air channel.
Figure 5C:
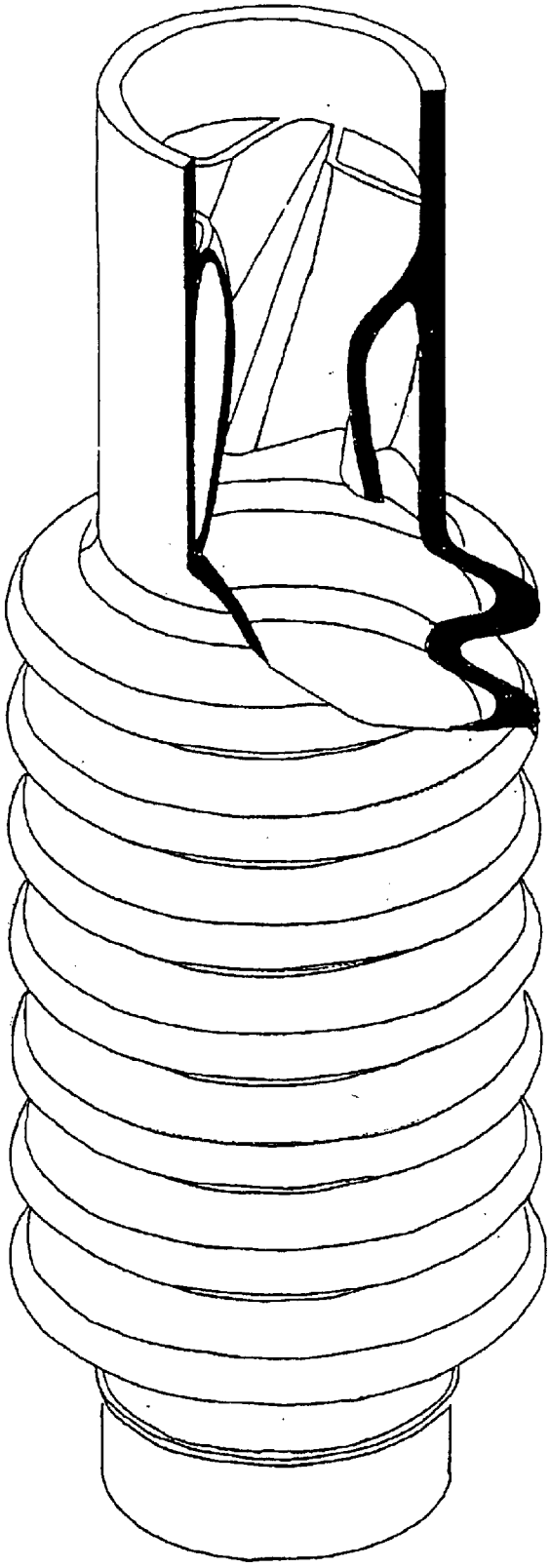
FIG. 5*c* is a perspective cut-out view of another embodiment, showing an air stirring device which is integrally constructed with an air channel.

FIG. 5*b* is another modification of this embodiment of the invention in which the blade acts as a joint for an air channel, and FIG. 5*c* is an air-stirring device which is integrally constructed with the body of an air channel.

In one embodiment, most of those modifications are made of nonmetal materials such as polymer. Only a few of them are made of metal.

It should necessarily be understood that the scope of this invention is not limited by the embodiments represented by the appended drawings. All modifications made by the people skilled in this art are still part of this invention as long as the principles underlying the modifications still exist within the scope of the invention.

What is claimed is:

1. An air-stirring blade to be mounted within an internal combustion engine, comprising:

a cylindrical body having a mid portion provided with blades, wherein an inner side of each of the blades has a groove with a dip angle of about 10° to 80° with respect to a vertical axis of the body, and each of the blades has a twisted center tunnel inner passage; and each of the blades having an outer side that has substantially same shape as the inner side thereof and at least two intersections between each of the blades and the body to form an outer passage with a cross section which is twisted along the body.

2. The air-stirring blade of claim 1 further comprising a lip around the cylindrical body.

3. The air-stirring blade of claim 1 wherein the blade and body are integrally constructed.

4. The air-stirring blade of claim 1 wherein there are at least four said intersections between the blades and the body.

5. The air-stirring blade of claim 1 wherein the dip angle is about 30°.

6. An air-stirring blade for mounting within an internal combustion engine, comprising:

a blade formed in a body and having an inner side with at least two coiled grooves, each coiled groove having a dip angle of about 10° to 80° with respect to a vertical axis of the body, the blade having a twisted center inner passage; and an outer side with substantially same shape as the inner side; wherein when the blade is inserted into an air duct, it has at least two intersections between the blade and the air duct forming an outer passage that is twisted along the body.

7. The air-stirring blade of claim 6 wherein there are four of the blades and there are at least four of the intersections.

8. The air-stirring blade of claim 1 or 6, wherein the blade is made of nonmetal materials.

9. The air-stirring blade of claim 1 or 6, wherein the blade is made of polymer.

10. The air-stirring blade of claim 1 or 6, wherein the blade is made of metal.

11. The blade of claim 6 wherein the dip angle is about 30°.

* * * * *

UNITED STATES PATENT AND TRADEMARK OFFICE

CERTIFICATE OF CORRECTION

PATENT NO. : 6,901,907 B2
DATED : June 7, 2005
INVENTOR(S) : Wijaya

It is certified that error appears in the above-identified patent and that said Letters Patent is hereby corrected as shown below:

Column 1,
Line 40, delete “maintain”, insert -- maintaining --.
Line 42, delete “increase”, insert -- increasing --.
Line 43, delete “outlet-side”, insert -- outlet side --.

Column 2,
Line 7, delete “S”, insert -- 5 --.
Line 14, delete “stirring stirring”, insert -- stirring --.
Line 17, delete “chanter”, insert -- chamber --.
Line 47, delete “air twisting-device”, insert -- air-twisting device --.

Column 3,
Line 2, delete “ensures as well as increases”, insert -- ensure as well as increase --.
Line 18, delete “engines”, insert -- engine --.
Line 66, delete “S”, insert -- 5 --.

Column 4,
Line 52, delete “side;”, insert -- side, --.

Signed and Sealed this

Eighteenth Day of April, 2006

JON W. DUDAS
*Director of the United States Patent and Trademark Office*